US012285112B2

(12) United States Patent
Whatcott et al.

(10) Patent No.: US 12,285,112 B2
(45) Date of Patent: Apr. 29, 2025

(54) MATTRESS ASSEMBLIES

(71) Applicant: Purple Innovation, LLC, Lehi, UT (US)

(72) Inventors: Russell B. Whatcott, Eagle Mountain, UT (US); Brock Keith Harris, Draper, UT (US); Dhyey Yogesh Acharya, Lehi, UT (US); Wade Hoover, Lehi, UT (US)

(73) Assignee: Purple Innovation, LLC, Lehi, UT (US)

( * ) Notice: Subject to any disclaimer, the term of this patent is extended or adjusted under 35 U.S.C. 154(b) by 168 days.

(21) Appl. No.: 17/701,446

(22) Filed: Mar. 22, 2022

(65) Prior Publication Data

US 2022/0296003 A1 Sep. 22, 2022

Related U.S. Application Data

(60) Provisional application No. 63/164,358, filed on Mar. 22, 2021.

(51) Int. Cl.
*A47C 27/15* (2006.01)
*A47C 27/00* (2006.01)

(52) U.S. Cl.
CPC ..... *A47C 27/15* (2013.01); *A47C 27/002* (2013.01)

(58) Field of Classification Search
CPC ..... A47C 27/15; A47C 27/001; A47C 27/002; A47C 27/144; A47C 27/148;
(Continued)

(56) References Cited

U.S. PATENT DOCUMENTS 1,291,036 A * 1/1919 Linman ..... A47C 31/105 5/499
2,400,731 A * 5/1946 Armstrong ..... A47C 31/105 5/500

(Continued)

FOREIGN PATENT DOCUMENTS

JP 2020-528803 A 10/2020
KR 20-0249361 9/2001

(Continued)

OTHER PUBLICATIONS

USPTO acting as International Searching Authority, "International Search Report and Written Opinion," International Application No. PCT/US2022/021400, Jun. 21, 2022.

(Continued)

*Primary Examiner* — Justin C Mikowski
*Assistant Examiner* — Alison N Labarge
(74) *Attorney, Agent, or Firm* — Foley & Lardner LLP

(57) ABSTRACT

A mattress that includes a bottom mattress assembly and a top mattress assembly that may be assembled with each other. An internal overlap may be associated with the bottom mattress assembly and protrude beyond a top of a bottom core of the bottom mattress assembly to define a receptacle for a base portion of the top mattress assembly. A cover top and a cover bottom may be placed over the assembly and secured to each other at a location vertically below an upper extent of the internal overlap. The mattress may be modular and, thus, include a bottom mattress assembly selectable from a plurality of different configurations of bottom mattress assemblies and/or a top mattress assembly selectable from a plurality of different configurations of top mattress assemblies. Methods for assembling bottom mattress assemblies and top mattress assemblies with one another to provide a complete mattress are also disclosed.

20 Claims, 6 Drawing Sheets

(58) Field of Classification Search
CPC ..... A47C 27/142; A47C 27/14; A47C 27/20; A47C 31/105; A47G 9/0238
See application file for complete search history.

(56) References Cited

U.S. PATENT DOCUMENTS

| | | | | |
|---|---|---|---|---|
| 6,413,458 | B1 | 7/2002 | Pearce | |
| 6,739,008 | B1 | 5/2004 | Kindrick | |
| 6,797,765 | B2 | 9/2004 | Pearce | |
| 6,839,929 | B2 | 1/2005 | Stolpmann | |
| 7,060,213 | B2 | 6/2006 | Pearce | |
| 7,076,822 | B2 | 7/2006 | Pearce | |
| 7,964,664 | B2 | 6/2011 | Pearce | |
| 8,919,750 | B2 * | 12/2014 | Pearce | A47C 7/02 267/153 |
| 8,935,180 | B2 | 1/2015 | Howard | |
| 10,555,618 | B2 | 2/2020 | Pearce | |
| 10,881,217 | B2 * | 1/2021 | Moon | A47C 27/053 |
| 2013/0139316 | A1 * | 6/2013 | Rabbany | A47C 31/105 29/428 |
| 2014/0143955 | A1 * | 5/2014 | Nishimura | A47C 21/046 5/724 |
| 2016/0157625 | A1 * | 6/2016 | Schneider | A47C 27/006 5/699 |
| 2017/0251825 | A1 | 9/2017 | Pearce | |
| 2017/0254003 | A1 | 9/2017 | Pearce | |
| 2018/0000255 | A1 * | 1/2018 | Youngblood | A47C 21/04 |
| 2021/0235884 | A1 * | 8/2021 | Nolte | A47C 27/001 |
| 2022/0095805 | A1 * | 3/2022 | Waggoner | A47C 27/002 |

FOREIGN PATENT DOCUMENTS

| | | | | |
|---|---|---|---|---|
| KR | 20-2018-0000340 | | 2/2018 | |
| KR | 10-2019-0071399 | B | 6/2019 | |
| KR | 20190071399 | A * | 6/2019 | A47C 27/12 |
| KR | 10-2020-0081490 | | 7/2020 | |
| WO | 2011072022 | A1 | 6/2011 | |

OTHER PUBLICATIONS

Extended European Search Report on EP 22776511.2 DTD Jan. 28, 2025.

* cited by examiner

MATTRESS ASSEMBLIES

CROSS-REFERENCE TO RELATED APPLICATION

A claim for priority is hereby made to the Mar. 22, 2021 filing date of U.S. Provisional Patent Application No. 63/164,358, titled MATTRESS ASSEMBLIES ("the '358 Provisional Application"), pursuant to 35 U.S.C. § 119(e). The entire disclosure of the '358 Provisional Application is hereby incorporated herein.

TECHNICAL FIELD

This disclosure relates generally to mattresses and, more specifically, to mattresses that include a bottom mattress assembly and a top mattress assembly that may be assembled with each other. In some embodiments, a mattress may be modular and, thus, include a bottom mattress assembly selectable from a plurality of different configurations of bottom mattress assemblies and/or a top mattress assembly selectable from a plurality of different configurations of top mattress assemblies. This disclosure also relates to methods for assembling bottom mattress assemblies and top mattress assemblies with one another to provide a complete mattress.

RELATED ART

The popularity of online mattress companies has increased dramatically over recent years. Online mattress companies enable an individual to select and order a mattress from a website, which then delivers the mattress directly to the consumer. Most online mattress companies provide their customers with trial periods during which the customer may try out the mattress. If a mattress does not meet a customer's expectations, the customer can typically send a return request to the online mattress company, which then sends a delivery company to pick the mattress up from the customer at no cost to the customer.

While online mattress companies have increased the ease with which consumers may select, purchase, try, and, if desired, return mattresses, packaged mattresses can be bulky and heavy. Thus, the delivery and installation of mattresses can be burdensome for both the delivery company and the consumer. In an effort to reduce the burden, some online mattress companies have developed compact packaging techniques (e.g., compressed, rolled mattresses, etc.) and packages (cylindrical packages with strategically positioned handles, etc.) that reduce the sizes and facilitate movement of their mattresses during storage, shipment, delivery, and set-up. Nevertheless, the weight of the mattress cannot be decreased, and some compactly packaged mattresses are still quite large.

SUMMARY

A mattress according to this disclosure may include a bottom mattress assembly and a top mattress assembly. The bottom mattress assembly and the top mattress assembly can be assembled with one another and, optionally, disassembled from each other. The mattress may include a cover with a cover bottom over a base and sides of the bottom mattress assembly and a cover top that may be placed over a top of the top mattress assembly and coupled to the bottom mattress assembly. The mattress may also include an internal overlap that extends around the sides of the top and bottom mattress assemblies. In some embodiments, the internal overlap can be secured to the cover bottom.

The bottom mattress assembly may include a bottom core. The bottom core may include a foundation that receives and supports one or more bottom cushioning elements. The bottom cushioning element(s) may comprise an array of coils, one or more pressurizable cell (e.g., with air, a gas, a liquid, etc.), memory foam, other cushioning structures that are suitable for use in mattresses, or combinations thereof. The bottom core of the bottom mattress assembly may also include an intermediate layer. The intermediate layer of the bottom core may cover the bottom cushioning element(s).

In some embodiments, a non-slip surface may be provided on an upper surface of a top of the bottom core. The non-slip surface may at least partially define a base of the receptacle defined by the internal overlap. The non-slip surface may comprise non-slip features defined from an elastomeric material. In some embodiments, the non-slip features may be printed onto the upper surface of the top of the bottom core (e.g., onto an upper surface of a bottom core cover, etc.). Together, the non-slip features may comprise a pattern of shapes on the upper surface of the top of the bottom core.

The internal overlap may laterally surround a periphery, or the sides, of the bottom core of the bottom mattress assembly. In addition, the internal overlap may protrude a first distance beyond a top of the bottom core to define a receptacle that can receive at least a base portion of the top mattress assembly; thus, the first distance may be less than or the same as a thickness of the top core. The internal overlap may align the top mattress assembly with the bottom mattress assembly. In some embodiments, the internal overlap may have sufficient rigidity to prevent a top core of the top mattress assembly from bulging laterally outward as a force is applied to a top of the assembled mattress (e.g., as one or more individuals lie on the mattress, etc.). The rigidity of the internal overlap may exceed a rigidity of the sides of the cover (e.g., the sides of the cover top, the sides of the cover bottom, etc.).

Once the top mattress assembly has been positioned within the receptacle defined by the internal overlap, a configuration of the internal overlap may enable it to be tightened around the top mattress assembly.

In some embodiments, the internal overlap may extend beneath at least peripheral portions of a base of the bottom core of the bottom mattress assembly. The internal overlap may be secured to the cover bottom. A bottom edge of the internal overlap may be coupled to the base of the cover bottom. The cover bottom may include a base that covers a base of the bottom core and sides that surround at least bottom portions of the sides of the internal overlap.

The top mattress assembly, which includes a base portion that may be inserted into the receptacle defined by the internal overlap, may include a top core and a top core cover. The top core may comprise an intermediate layer and one or more top cushioning elements on the intermediate layer. Examples of top cushioning elements include, but are not limited to, gel cushions, foams, memory foams, other cushioning structures, or combinations of any of the foregoing. Without limitation, the gel cushion may comprise a gel cushion of the type disclosed by U.S. Pat. Nos. 7,060,213, 7,076,822, and 8,919,750, the entire disclosures of which are hereby incorporated herein. Such a gel cushion may include a plurality of resiliently compressible interconnected walls defining an array of interconnected, resiliently buckling columns, with a void in each column. Such a gel cushion may be formed from any of a variety of compressible, resilient materials, including cushioning foams and elastomeric materials, such as the extended A-B-A triblock copolymers disclosed by U.S. Pat. Nos. 6,413,458, 6,797,765, and 7,964,664, the entire disclosures of which are hereby incorporated herein. The top core may also include one or more lateral supports surrounding a periphery of the top cushioning element(s).

The top core cover may encase the top core. Thus, the top core cover may include a top over a top of the top core, a base beneath a base of the top core, and sides extending around an outer periphery of the top core.

In some embodiments, a non-slip surface may be provided on a lower surface of a base of the top core cover. Such a non-slip surface may comprise non-slip features formed from an elastomeric material. The non-slip features may be printed onto the lower surface of the base of the top core cover. Together, the non-slip features may comprise a pattern of shapes on the lower surface of the base of the top core.

The mattress cover may include the cover bottom, a cover top, and a fastener. The cover bottom may include a base beneath the bottom core of the bottom mattress assembly and sides extending around the sides of the internal overlap of the bottom mattress assembly. The sides of the cover bottom may extend beyond a top of the bottom core. More specifically, the sides of the cover bottom may extend a second distance beyond the top of the bottom core. In some embodiments, the second distance the sides of the cover bottom protrude beyond the top of the bottom core is less than the first distance the sides of the internal overlap protrude beyond the top of the bottom core; thus, the sides of the internal overlap may protrude farther than the sides of the cover bottom. In other embodiments, the second distance may be the same as or greater than the first distance. In some embodiments, the cover bottom may comprise part of the bottom mattress assembly.

The cover top may include a top and sides. The top of the cover top may be located over the top core of the top mattress assembly. In some embodiments, the top of the cover top may be positionable over a top of the top core cover of the top mattress assembly. In other embodiments, the top of the cover top and the top of the top cover may comprise the same element. The sides of the cover top may extend around the sides of the top core cover. The sides of the cover top and the sides of the top core cover may be associated with each other in such a way that a top portion of the internal overlap, which protrudes beyond the top of the bottom core, may be insertable, or receivable, between the sides of the cover top and the sides of the top core cover.

The fastener may include a bottom fastener positioned along upper edges of the sides of the cover bottom and a top fastener positioned along lower edges of the sides of the cover top. In embodiments where the internal overlap is secured to the cover bottom, the combination of the internal overlap and the fastener may impart the mattress with increased tensile strength; in some embodiments, the mattress may have as much or more tensile strength as a mattress of the same internal configuration but unitary sidewalls.

Multiple additional fasteners may also be employed. For example, a fastener may secure a periphery of a top portion of the bottom mattress assembly to a periphery of a bottom portion of the top mattress assembly. As another example, a fastener may secure upper edges of the sides of the cover bottom to intermediate portions of the sides of the internal overlap. Such fasteners may be vertically offset from each other and/or from the fastener of the cover of the mattress assembly. The use of such offset fasteners may impart the mattress with increased tensile strength; in some embodiments, the mattress may have as much or more tensile strength as a mattress of the same internal configuration but unitary sidewalls.

In some embodiments, the mattress assembly may comprise a modular mattress assembly. A modular mattress assembly may include a bottom mattress assembly selectable from or selected from a plurality of different configurations of bottom mattress assemblies and/or a top mattress assembly selectable from and/or selected from a plurality of different configurations of top mattress assemblies. In some embodiments, two top mattress assemblies that may be to be arranged side-by-side may be selected from a plurality of different configurations of top mattress assemblies. Such a modular mattress may enable a consumer or a couple of consumers to select from a plurality of different configurations of bottom mattress assemblies and/or a plurality of different configurations of top mattress assemblies.

The bottom mattress assembly and each top mattress assembly may be packaged and shipped separately from each other, providing for two or more packages that each weigh significantly less than and are significantly smaller than a single package if the bottom mattress assembly and top mattress assembly(ies) were assembled into a mattress and shipped together.

In another aspect, methods for assembling mattresses are disclosed. Such a method includes providing a bottom mattress assembly with an internal overlap defining a receptacle over a bottom core. A base portion of a top mattress assembly may be inserted into the receptacle of the bottom mattress assembly. In some embodiments, at least one non-slip surface may be provided between the bottom core and the top mattress assembly. With the top mattress assembly in place, the internal overlap may be laterally tightened around a periphery of the top mattress assembly. A cover top may then be placed over the top mattress assembly and secured to a cover bottom on the bottom mattress assembly, which cover bottom may be provided as part of the bottom mattress assembly.

Such a method may be employed by a consumer, who may assemble parts separately shipped parts of a mattress. Such a method may also enable consumers to select and assemble the components of a modular mattress. More specifically, a consumer or a couple of consumers may select a bottom mattress assembly from a plurality of bottom mattress assemblies of different configurations and/or a top mattress assembly from a plurality of top mattress assemblies of different configurations. In some embodiments, the consumer or couple of consumers may select at least two top mattress assemblies to be arranged side-by-side over the bottom mattress assembly The consumer or couple of consumers may even select a cover top from a plurality of cover tops of different configurations.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
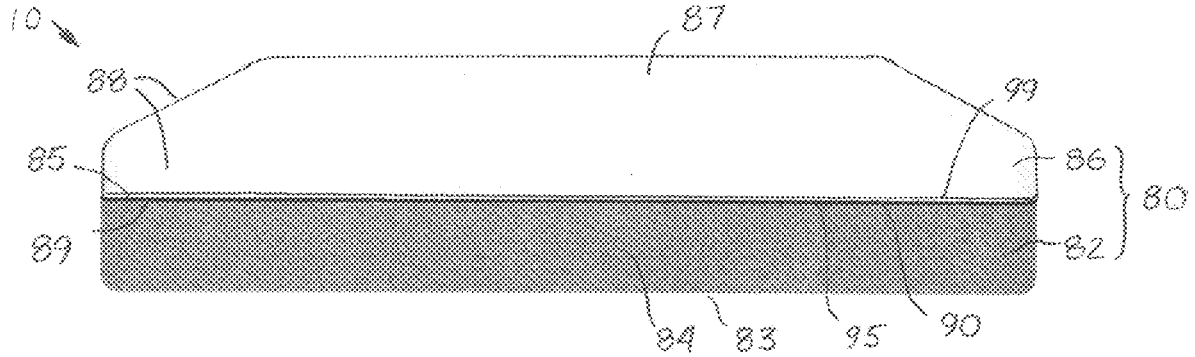
FIG. 1 is a front perspective view of an embodiment of a mattress assembly according to this disclosure.

FIGS. 1-4 depict an embodiment of a mattress assembly 10 that includes a lower mattress assembly 20, an internal overlap 40, an upper mattress assembly 60, and a cover 80. Configurations of the lower mattress assembly 20, internal overlap 40, upper mattress assembly 60, and cover 80 may enable the lower mattress assembly 20 and the upper mattress assembly 60 to be provided (e.g., selected, purchased, shipped, etc.) separately from one another, assembled, and secured to each other.

As illustrated by FIG. 1, the cover 80 of the mattress assembly 10 may include a cover bottom 82 and a cover top 86. The cover bottom 82 includes a base 83 (FIG. 2) and sides 84, with each side 84 including an upper edge 85. The cover top 86 includes a top 87 and sides 88, which each side 88 including a lower edge 89.

Any of a variety of suitable materials may be used to define the cover bottom 82 and the cover top 86. For example, the top 87 of the cover top 86 and, optionally, the sides 88 of the cover top 86, the sides 84 of the cover bottom 82, and/or the base 83 of the cover bottom 82 may be at least partially formed from a stretchable fabric. Some non-limiting examples of suitable fabrics are disclosed by U.S. Patent Application Publication US 2017/0251825 A1 (e.g., the base 83 of the cover bottom 82, the sides 84 of the cover bottom 82, the sides 88 of the cover top 86, and/or the top 87 of the cover top 86), U.S. Patent Application Publication US 2017/0254003 A1 (e.g., the top 87 of the cover top 86, the sides 88 of the cover top 86, the sides 84 of the cover bottom 82, etc.), U.S. Pat. No. 10,555,618 (e.g., the top 87 of the cover top, etc.), and U.S. Pat. No. 10,881,217 (e.g., the sides 84 of the cover bottom 82, the sides 88 of the cover top 86, etc.), the entire disclosures of which are hereby incorporated herein.

As illustrated, one or more characteristics (e.g., texture/design, color, fabric, etc.) of the materials of the cover bottom 82 and cover top 86 and their features (e.g., base 83 and top 87, respectively; sides 84 and 88, respectively; etc.) may differ. Alternatively, various characteristics (e.g., one, some, all, etc.) of the material of the cover bottom 82 or a portion thereof (e.g., sides 84, etc.) and the material of the cover top 86 or a portion thereof (e.g., sides 88, the top 87, etc.) may be the same.

The cover 80 may also include at least one fastener 90. The at least one fastener 90 may include lower element 95 and an upper element 99, which may have configurations that enable them to be coupled to each other. In some embodiments, the lower element 95 and upper element 99 of the fastener 90 may reversibly couple to each other. The lower element 95 of the fastener 90 may be associated with (e.g., secured to, comprise an integral part of, etc.) the sides 84 of the cover bottom 82 at or adjacent the upper edge 85 of the sides 84. The upper element 99 of the fastener 90 may be associated with (e.g., secured to, comprise an integral part of, etc.) the sides 88 of the cover top 86 at or adjacent to a lower edge 89 of the sides 88. In various embodiments, the lower element 95 and upper element 99 of the fastener 90 may comprise sides of a zipper (in which case the fastener 90 would also include at least one zipper pull), sides of a touch fastener (e.g., a hook and loop, or "Velcro," fastener; a hook-hook fastener; etc.), buttons and buttonholes, complementary snap-fit elements, or "snaps," or the like.

Figure 2:
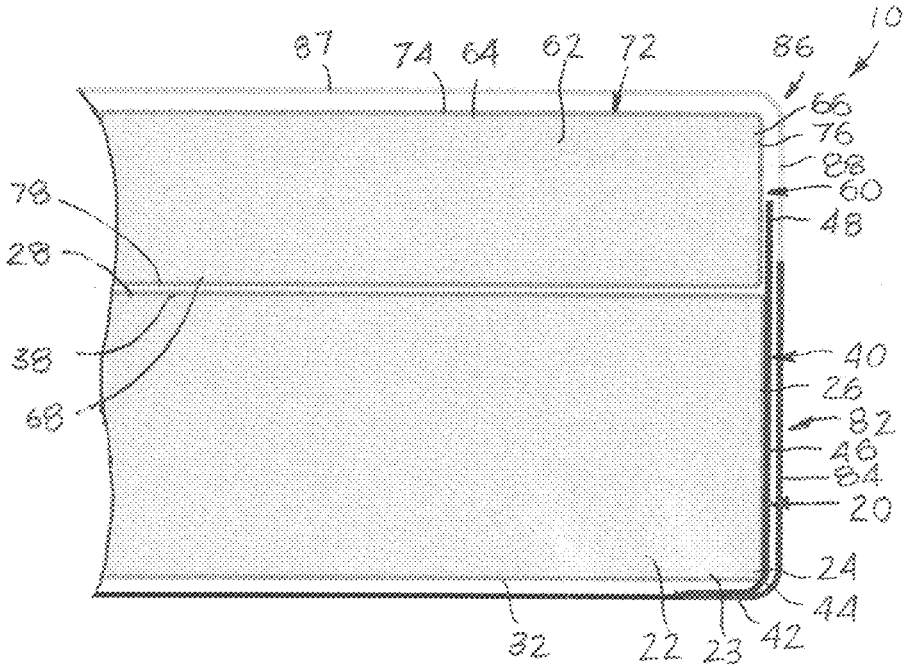
FIG. 2 is a partial cross-sectional view of the embodiment of the mattress assembly shown in FIG. 1.
Figure 3:
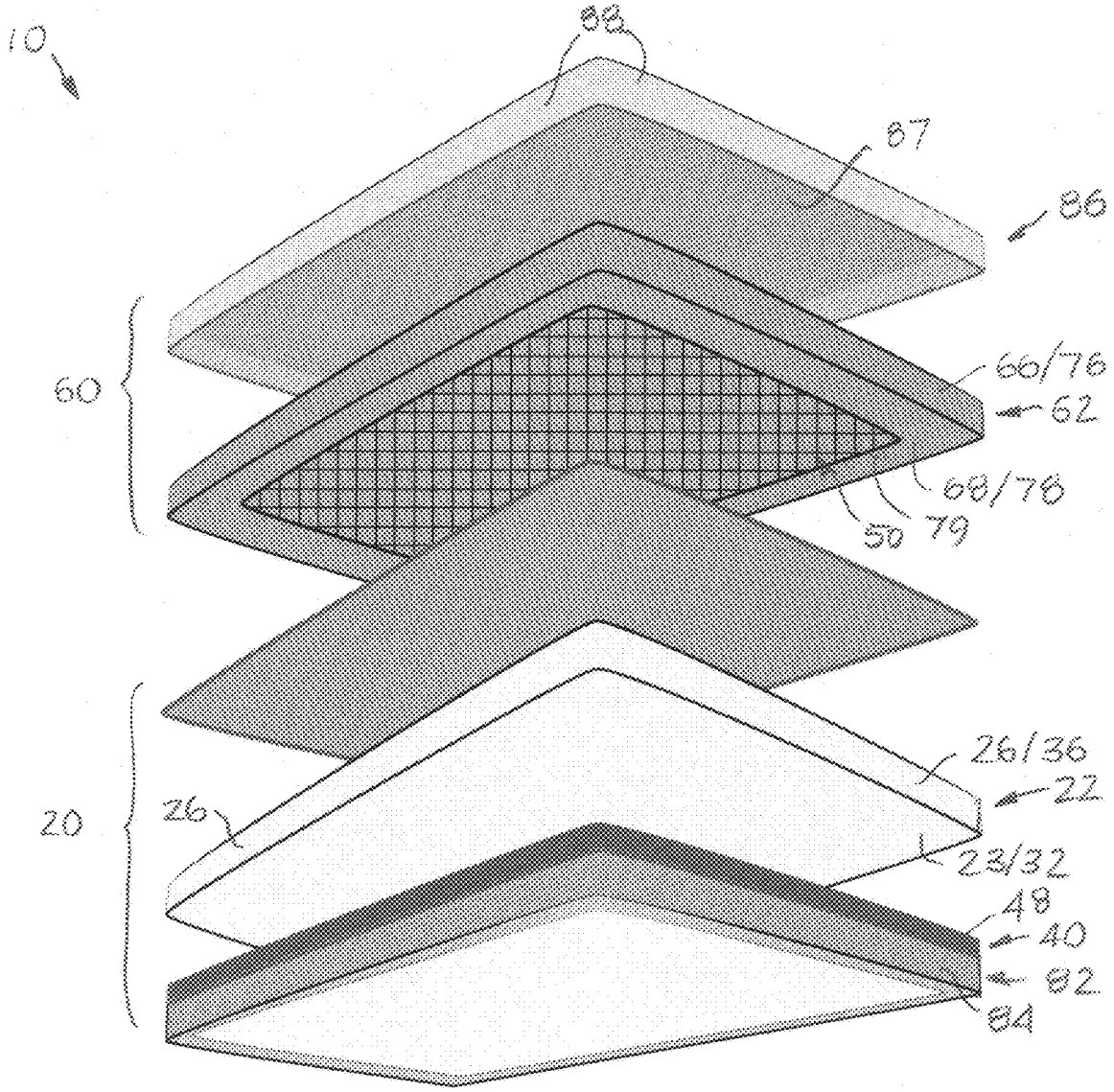
FIG. 3 is an exploded isometric view of the embodiment of the mattress assembly shown in FIG. 1.
Figure 4:
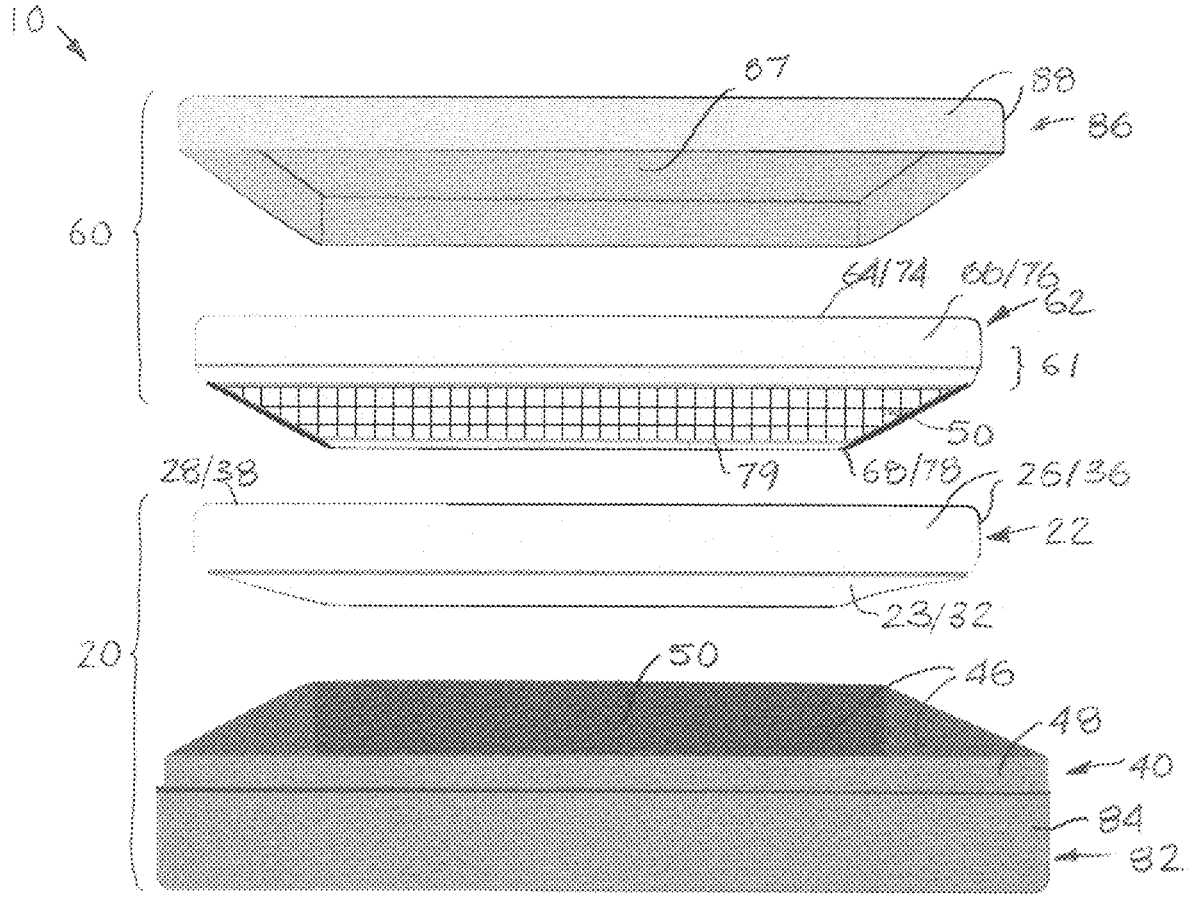
FIG. 4 is an exploded perspective view of the embodiment of the mattress assembly shown in FIG. 1.

In addition to showing features of the cover 80, FIGS. 2-4 generally illustrate internal components of the mattress assembly 10, including the bottom mattress assembly 20, the internal overlap 40, and the top mattress assembly 60.

The bottom mattress assembly 20 may include a bottom core 22. Although FIGS. 2-4 do not depict details of the bottom core 22, the bottom core 22 may include a foundation that receives and supports one or more bottom cushioning elements. The bottom cushioning element(s) may comprise an array of coils (see, e.g., U.S. Patent Application Publication US 2019/0150632 A1, the entire disclosure of which is hereby incorporated herein), one or more pressurizable cells (e.g., with air, a gas, a liquid, etc.) (see, e.g., U.S. Pat. No. 11,213,139, the entire disclosure of which is hereby incorporated herein), memory foam, other cushioning structures that are suitable for use in mattresses, or combinations thereof. An intermediate layer of the bottom core 22 may cover the bottom cushioning element(s). The intermediate layer may comprise a foam (e.g., a compressible, resilient foam, a memory foam, etc.).

In some embodiments, the bottom mattress assembly 20 may also include a bottom core cover 32 that covers, surrounds, and/or encapsulates the elements that define the bottom core 22 (e.g., foundation, coils, pressurizable cells (s), intermediate layer, etc.). The bottom core cover 32 may include a fastener (e.g., a zipper, a touch fastener, buttons and buttonholes, snaps, etc.) to hold the elements that define the bottom core 22 within the bottom core cover 32.

Figure 5A:
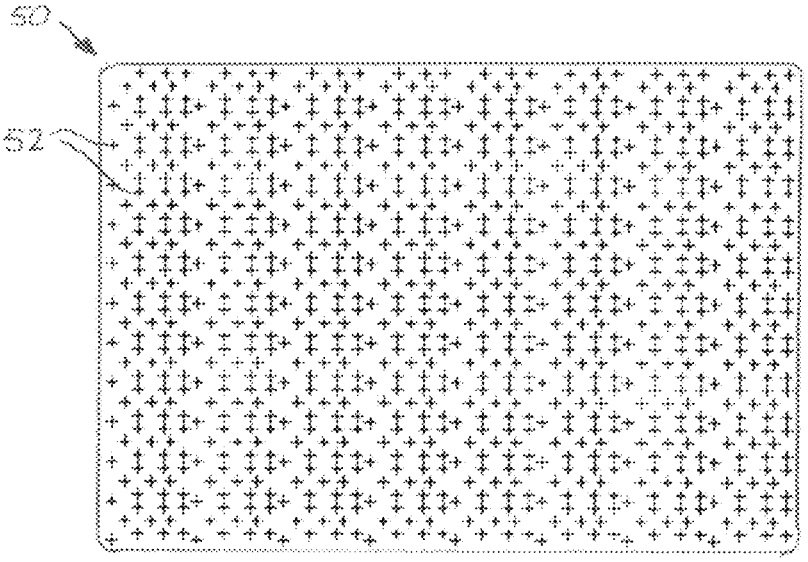
FIG. 5A illustrates an embodiment of a non-slip surface of a mattress assembly according to this disclosure.

An upper surface 38 of the bottom core 22 or the bottom core cover 32 may comprise a non-slip surface 50, such as that depicted by FIG. 5A. The non-slip surface 50 may comprise non-slip features 52 formed from an elastomeric material. Without limitation, the elastomeric material may comprise a silicone, an A-B-A triblock copolymer, which may be extended with a plasticizer (e.g., the plasticizer extended A-B-A triblock copolymers disclosed by U.S. Pat.

Nos. 6,413,458, 6,797,765, and 7,964,664, etc.), or any other elastomeric material that will prevent two surfaces positioned against each other from slide relative to one another.

Figure 5B:
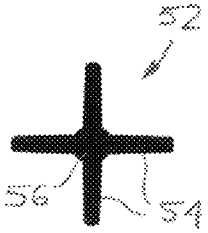
FIG. 5B provides an enlarged top view of a non-slip feature of embodiment of non-slip surface shown in FIG. 5A.

FIG. 5B shows a specific, but non-limiting example of a non-slip feature 52. The non-slip feature 52 shown in FIG. 5B has the shape of an equilateral cross with two cross members 54 and a center 56. Each cross member has a length of about 15 mm and a width of about 1 mm to about 1.5 mm. The center 56 is slightly enlarged relative to the widths of the cross members 54, measuring about 3 mm across. Of course, other shapes and sizes of non-slip features 52 are also within the scope of this disclosure.

Referring again to FIGS. 2-4, the internal overlap 40 extends around at least a portion of the outer periphery, or sides 26, of the bottom core 22. More specifically, sides 46 of the internal overlap 40 may extend at least partially around the sides 26 of the bottom core 20. The sides 46 of the internal overlap 40 may be secured to the sides 84 of the cover bottom 82 (e.g., at a plurality of spaced apart locations, such as by stitching, during knitting of the sides 84, with an adhesive, etc.).

A top portion 48 of the internal overlap 40 may protrude beyond a top 28 of the bottom core 22. Thus, the top portion 48 of the internal overlap 40 may define a receptacle 50 over the bottom core 22. The receptacle may 50 receive a base portion 61 of the top mattress assembly 60.

The internal overlap 40 may include a bottom corner 44 at a bottom of the sides 46. The bottom corner 44 may be positioned beneath and wrap around a bottom corner 24 of the bottom core 22. An internal overlap 40 with a bottom corner 44 may also include a bottom portion 42. The bottom portion 42 may extend laterally inward and, thus, may be positioned beneath peripheral portions of a bottom 23 of the bottom core 22. The cover bottom 82 may receive and cover the sides 46 and bottom portion 44 of the internal overlap 40 and the sides 26 and bottom 23 of the bottom core 22.

Figure 6:
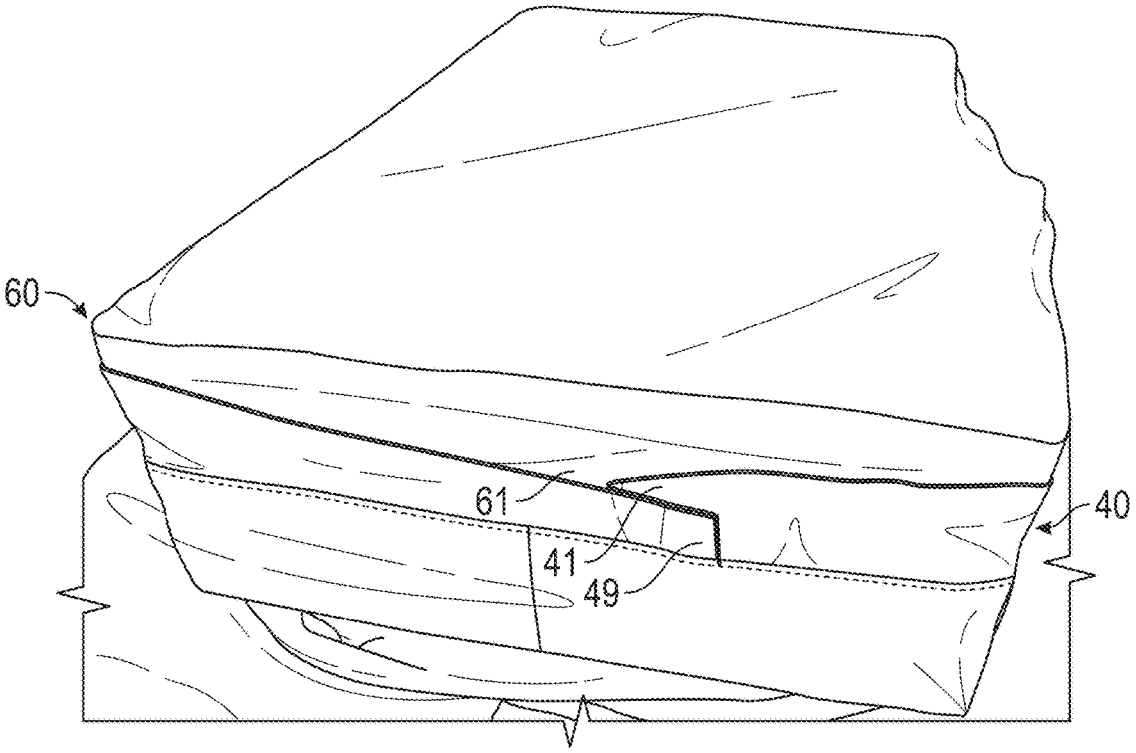
FIG. 6 is a perspective view showing an internal overlap around a bottom mattress assembly and a bottom portion of a top mattress assembly that has been placed on the bottom mattress assembly.

In some embodiments, the internal overlap 40 may extend around an entirety of the outer periphery of the bottom core 22, or completely around the sides 26 of the bottom core 22. As shown in FIG. 6, in embodiments where the internal overlap 40 extends around the entire outer periphery of the bottom core 22, the internal overlap 40 may include ends 41 and 49 that may be pulled in opposite directions and secured in place relative to one another to enable tightening of the internal overlap 40 (e.g., around the base portion 61 of the top mattress assembly 60).

The internal overlap 40 may comprise a material that has very little lateral stretch (e.g., less than less than two percent, less than one percent, etc.) or that does not stretch laterally. In some such embodiments, the internal overlap 40 may comprise a nonwoven fabric (e.g., felt, a fabric-like material made from staple fibers (short) and long fibers (continuous long) that are bonded together, etc.). The nonwoven fabric may comprise a reinforced nonwoven fabric and/or include a backing. In other embodiments, the internal overlap 40 may comprise a somewhat rigid element (e.g., a plastic sheet, etc.).

With reference again returned to FIGS. 2-4, the base portion 61 of the top mattress assembly 60 may be inserted into and reside within the receptacle 50 defined by the top portion 48 of the internal overlap 40. The top mattress assembly 60 may include a top core 62 and a top core cover 72. Although FIGS. 2-4 do not depict details of the top core 62, the top core 62 may include an intermediate layer and one or more top cushioning elements on the intermediate layer. The intermediate layer may comprise a foam (e.g., a compressible, resilient foam, a memory foam, etc.). Examples of top cushioning elements include, but are not limited to, gel cushions, foams, memory foams, other cushioning structures, or combinations of any of the foregoing. Without limitation, the gel cushion may comprise a gel cushion of the type disclosed by U.S. Pat. Nos. 7,060,213, 7,076,822, and 8,919,750, the entire disclosures of which are hereby incorporated herein. Such a gel cushion may include a plurality of resiliently compressible interconnected walls defining an array of interconnected, resiliently buckling columns, with a void in each column. Such a gel cushion may be formed from any of a variety of compressible, resilient materials, including cushioning foams and elastomeric materials, such as the extended A-B-A triblock copolymers disclosed by U.S. Pat. Nos. 6,413,458, 6,797,765, and 7,964,664, the entire disclosures of which are hereby incorporated herein. The top core 62 may also include one or more lateral supports surrounding a periphery of the top cushioning element(s).

The top core cover 72 may encase the top core 62. The top core cover 72 may cover, surround, and/or encapsulate the elements that define the top core 62 (e.g., layer(s) of foam, memory foam, top cushioning element(s) (e.g., a gel cushion, etc.), etc.). The top core cover 72 may include a top 74 over a top 64 of the top core 62, a base 78 beneath a base 68 of the top core 62, and sides 76 extending around an outer periphery, or sides 66, of the top core 62. In addition, the top core cover 72 may include a fastener (e.g., a zipper, a touch fastener, buttons and buttonholes, snaps, etc.) to hold the elements that define the top core 62 within the top core cover 72.

In some embodiments, a lower surface 79 of the base 78 of the bottom core cover 72 may comprise a non-slip surface 50 with non-slip features 52 thereon. The non-slip features 52 may be formed from any suitable material (e.g., an elastomeric material, etc.) and have any suitable shape and size. In embodiments where one or both of the bottom mattress assembly 20 and the top mattress assembly 60 includes a non-slip surface 50, the non-slip surface(s) 50 may prevent the top mattress assembly 60 from sliding laterally relative to the bottom mattress assembly 20.

The cover top 86 may be positioned over the top core cover 72. More specifically, the top 87 of the cover top 86 may be positioned over the top 74 of the top core cover 72, while the sides 88 of the cover top 86 may overlap at least top portions of the sides 76 of the top core cover 72. The sides 88 of the cover top 86 and the sides 76 of the top core cover 72 may be associated with each other in such a way that the top portion 48 of the internal overlap 40 may be positioned between sides 88 and sides 76.

Figure 7:
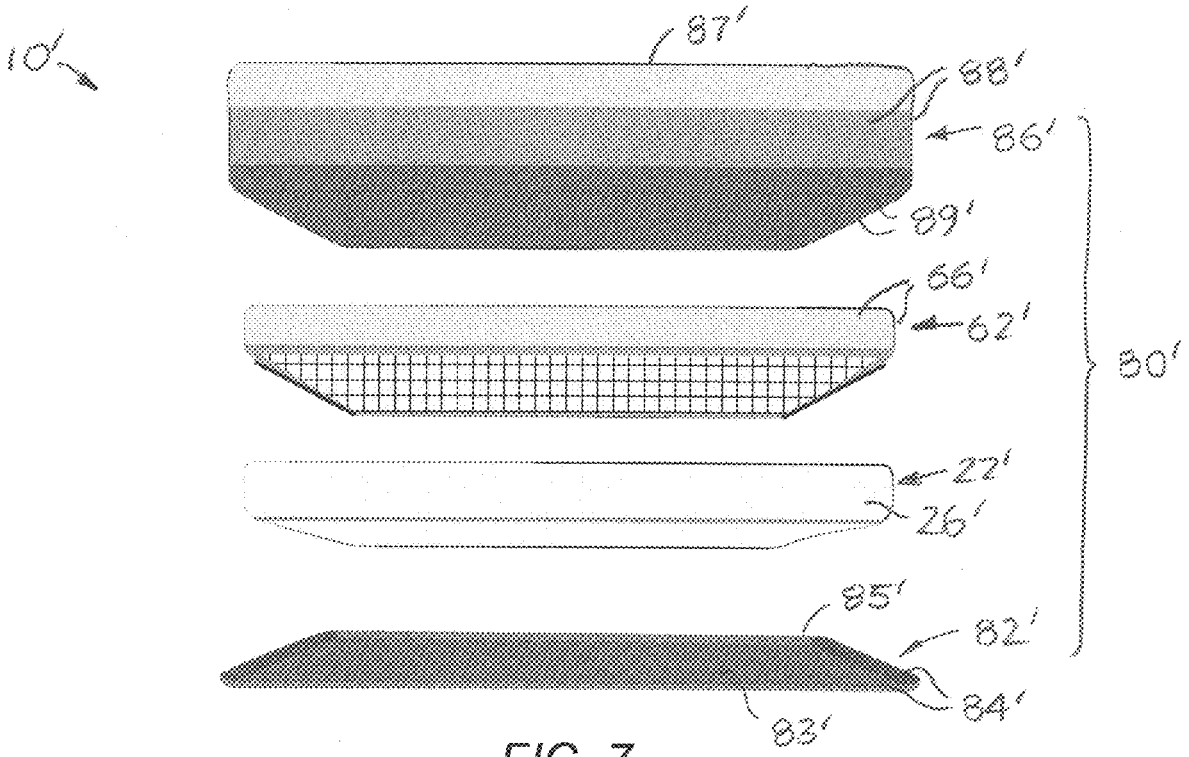
FIG. 7 is an exploded perspective view of another embodiment of a mattress assembly according to this disclosure.

Turning now to FIG. 7, an embodiment of a mattress assembly 10' with a cover 80' that varies from that illustrated by and described in reference to FIGS. 1-4 is depicted. The cover 80' includes a cover bottom 82' and a cover top 86'.

The cover bottom 82' includes a base 83' and corners 84', with each corner 84' including an upper edge 85'. The corners 84' of the cover bottom 82' only extend slightly, if at all, up the sides 26' of the bottom core 22'.

The cover top 86' includes a top 87' and sides 88', which each side 88' including a lower edge 89'. The sides 88' have a height equal to combined heights of the sides 26' of the bottom core 22' and the sides 66' of the top core 62'. Thus, when the top core 62' is assembled with the bottom core 22' and the cover top 86' is placed over the assembly, the sides 88' of the cover top 86' extend over the sides 66' of the top core 62' and mostly, if not completely, over the sides 26' of the bottom core 22' to a location where the lower edge 89' of the cover top 86' may be joined to the upper edge 85' of the cover bottom 82'.

Figure 8:
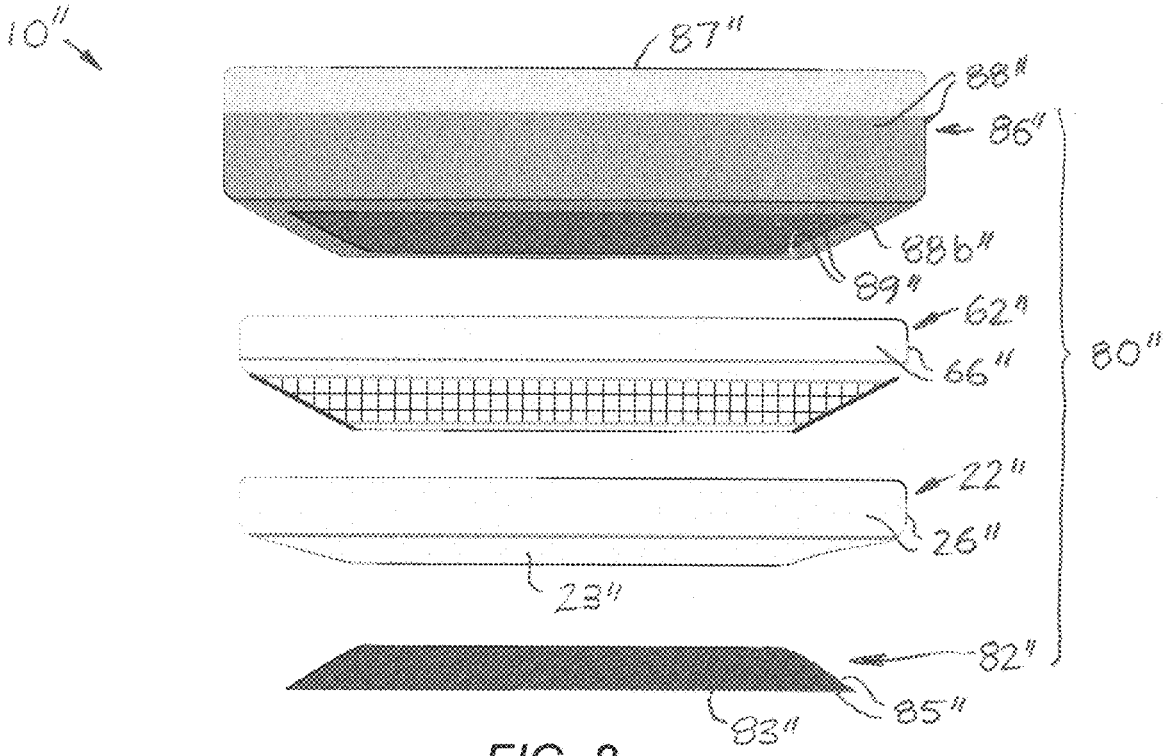
FIG. 8 is an exploded perspective view of yet another embodiment of a mattress assembly according to this disclosure.

FIG. 8 shows an embodiment of a mattress assembly 10" with an embodiment of a cover 80". The cover 80" shown in FIG. 8 includes a cover bottom 82" and a cover top 86".

The cover bottom 82" includes a base 83" with peripheral edges 85". The cover bottom 82" has smaller dimensions than the bottom 23" of the bottom core 22". Thus, the peripheral edges 85" of the cover bottom 82" may be positioned beneath the bottom 23" of the bottom core 22".

The cover top 86" includes a top 87" and sides 88" with a bottom portion 88*b*" that extends inwardly from to a lower edge 89". The sides 88" have a height equal to combined heights of the sides 26" of the bottom core 22" and the sides 66" of the top core 62". Thus, when the top core 62" is assembled with the bottom core 22" and the cover top 86" is placed over the assembly, the sides 88" of the cover top 86" extend over the sides 66" of the top core 62" and over the sides 26" of the bottom core 22". In addition, the bottom portion 88*b*" of the sides 88" of the cover top 86" extend beneath peripheral portions of the bottom 23" of the bottom core 22" to a location where the lower edge 89" of the cover top 86" may be joined to the peripheral edge 85" of the cover bottom 82".

Figure 9:
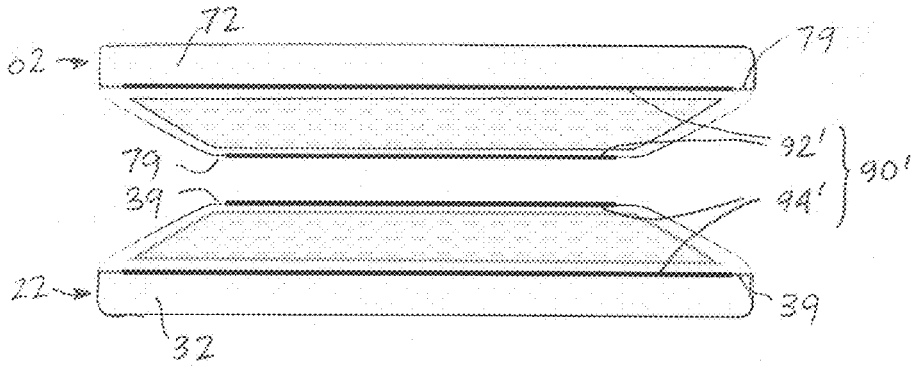
FIG. 9 is an exploded perspective view depicting a manner in which a top mattress assembly may be secured to a bottom mattress assembly.
Figure 10:
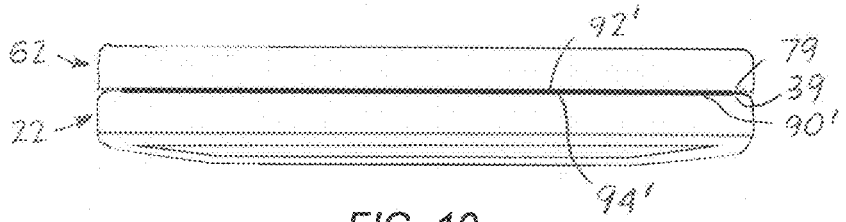
FIG. 10 is a perspective view of the top mattress assembly and bottom mattress assembly of FIG. 9 secured to each other to define an interior mattress assembly.

With reference to FIG. 9, elements 92' and 94' of a fastener 90' may be provided on or adjacent to corners 39 and 79 of the bottom core cover 32 and top core cover 72, respectively. As the top core 62 is positioned over and aligned with the bottom core 22, adjacent corners 39 and 79 and their associated elements 92' and 94' of the fastener 90' are brought into proximity to one another, as shown in FIG. 10. The elements 92' and 94' of the fastener 90' may then be secured to each other, securing the top core 22 to the bottom core 62 and preventing the top core 22 from sliding or otherwise moving laterally relative to the bottom core 62.

Figure 11:
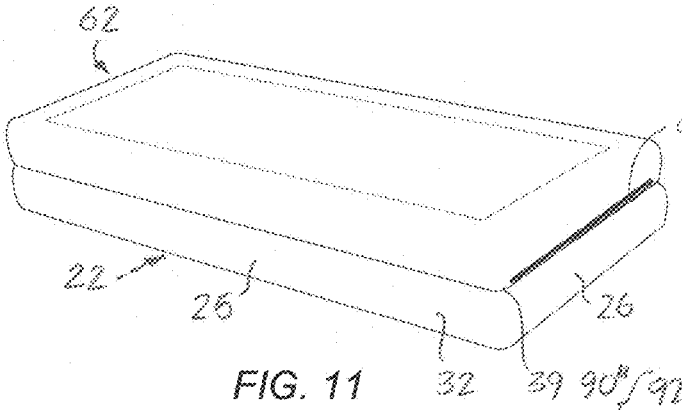
FIG. 11 is an isometric view of an interior mattress assembly showing an element of a fastener on an exterior surface thereof.
Figure 12:
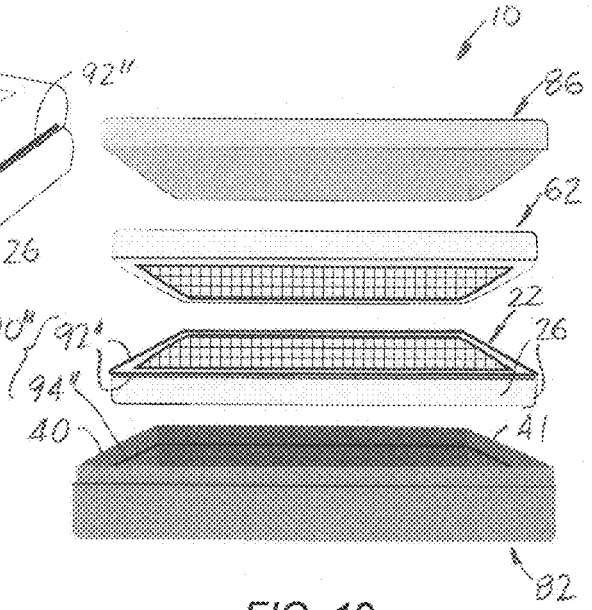
FIG. 12 is an exploded perspective view depicting a manner in which components of a bottom mattress assembly may be secured together with a fastener such as that depicted by FIG. 11.

As shown in FIGS. 11 and 12, elements 92" and 94" of a fastener 90" may be provided on or adjacent to corners 39 of the bottom core cover 32 and at an intermediate location along the height of an inside surface 41 of the internal overlap 40, respectively. When the elements 92" and 94" of the fastener 90" are brought into proximity to each other and coupled to one another, the internal overlap 40 may be secured in place relative to the sides 26 of the bottom core 22. In embodiments where the bottom core 22 may also be coupled to the top core 62, as depicted by FIG. 11, the embodiment of fastener 90" shown in FIGS. 11 and 12 may be used to secure the internal overlap 40 in place relative to an entire interior assembly of the mattress assembly 10.

In embodiments where either or both of the types of coupling depicted by FIGS. 9 and 10 and by FIGS. 11 and 12 are provided with the coupling that the fastener 90 shown in FIGS. 1-4 provides between the cover bottom 82 and cover top 86, which locations at which the various elements of the various components of the mattress assembly are coupled to each other may be vertically offset from each other. Such an arrangement may impart the mattress with increased tensile strength; in some embodiments, the mattress may have as much or more tensile strength as a mattress of the same internal configuration but unitary sidewalls.

Methods involving a mattress assembly 10 according to this disclosure and its components, including but not limited to methods for assembling and disassembling the components of the mattress assembly 10, should be apparent from the description provided above and the accompanying drawings.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A mattress, comprising:

a bottom mattress assembly including:

a bottom core; and an internal overlap including a base extending beneath the bottom core and sides extending around an outer periphery of the bottom core and protruding a first distance beyond a top of the bottom core to define a receptacle;

a top mattress assembly insertable into the receptacle defined by the internal overlap of the bottom mattress assembly and including:

a top core including a plurality of superimposed layers; and a top cover encasing an entirety of the top mattress assembly and including a top over a top of the top mattress assembly, a base beneath a base of the top mattress assembly, and sides extending around an outer periphery of the top mattress assembly; and a mattress cover, including:

a cover bottom including a base beneath the bottom core of the bottom mattress assembly;

a cover top including a top positionable over a top of the top cover of the top mattress assembly and sides extending around the sides of the top cover, wherein a first portion of the sides of the cover top are adjacent the sides of the top cover and a second portion of the sides of the cover top are adjacent the sides of the internal overlap; and a reversible fastener including a bottom fastener positioned along edges of the cover bottom and a top fastener positioned along edges of the sides of the cover top.

2. The mattress of claim 1, wherein the first distance is less than a thickness of the top core.

3. The mattress of claim 2, wherein the cover bottom further includes sides extending around the sides of the internal overlap of the bottom mattress assembly and protruding a second distance beyond a top of the bottom core.

4. The mattress of claim 3, wherein the second distance the sides of the cover bottom protrude beyond the top of the bottom core is less than the first distance the sides of the internal overlap protrude beyond the top of the bottom core.

5. The mattress of claim 3, wherein a side of the internal overlap is secured to a side of the cover bottom.

6. The mattress of claim 1, wherein another reversible fastener secures the internal overlap to the bottom core.

7. The mattress of claim 1, wherein the internal overlap is laterally adjustable.

8. The mattress of claim 1, further comprising:

a non-slip surface between the bottom mattress assembly and the top mattress assembly.

9. The mattress of claim 8, wherein the non-slip surface is on at least one of the base of the top cover of the top mattress assembly.

10. The mattress of claim 8, wherein the non-slip surface comprises non- slip features formed from an elastomeric material.

11. The mattress of claim 1, wherein the top core comprises a gel cushion comprising intersecting walls formed from an elastomeric material and defining an array of voids.

12. The mattress of claim 11, wherein the bottom core comprises an array of coils.

13. The mattress of claim 11, wherein the bottom core comprises at least one pressurizable cell.

14. A method for assembling a mattress, comprising:

providing a bottom mattress assembly with an internal overlap defining a receptacle over a bottom core;

inserting a base portion of a top mattress assembly that includes a plurality of superimposed layers and a top cover encasing an entirety of the top mattress assembly and including sides extending around an outer periphery of the top mattress assembly into the receptacle of the bottom mattress assembly; and securing a cover top on the top mattress assembly to a cover bottom on the bottom mattress assembly, wherein a first portion of sides of the cover top are adjacent the sides of the top cover and a second portion of the sides of the cover top are adjacent sides of the internal overlap.

15. The method of claim 14, further comprising:

laterally tightening the internal overlap around the outer periphery of the top mattress assembly.

16. The method of claim 14, further comprising:

placing the cover top over a top of the top mattress assembly.

17. The method of claim 16, wherein providing the bottom mattress assembly comprises providing a bottom mattress assembly with which a cover bottom has been assembled.

18. The method of claim 14, further comprising:

selecting the bottom mattress assembly from a plurality of bottom mattress assemblies of different configurations.

19. The method of claim 14, further comprising:

selecting the top mattress assembly from a plurality of top mattress assemblies of different configurations.

20. The method of claim 19, wherein selecting the top mattress assembly comprises selecting at least two top mattress assemblies to be arranged side-by-side over the bottom mattress assembly.

* * * * *